US007525502B2

(12) United States Patent
Hui et al.

(10) Patent No.: US 7,525,502 B2
(45) Date of Patent: Apr. 28, 2009

(54) ISOLATION BETWEEN ANTENNAS USING FLOATING PARASITIC ELEMENTS

(75) Inventors: Ping Hui, Richmond (CA); Jari Van Wonterghem, Vancouver (CA)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 11/157,404

(22) Filed: Jun. 20, 2005

(65) Prior Publication Data

US 2006/0038736 A1 Feb. 23, 2006

Related U.S. Application Data

(60) Provisional application No. 60/603,452, filed on Aug. 20, 2004.

(51) Int. Cl.
*H01Q 1/24* (2006.01)
*H01Q 21/00* (2006.01)

(52) U.S. Cl. ..... 343/835; 343/702; 343/834; 343/841; 343/846

(58) Field of Classification Search ..... 343/700 MS, 343/702, 841, 833, 834, 835, 846
See application file for complete search history.

(56) References Cited

U.S. PATENT DOCUMENTS 2,455,403 A * 12/1948 Brown ..... 343/836
2,947,987 A * 8/1960 Dodington ..... 343/705
3,541,559 A * 11/1970 Evans ..... 343/756
4,460,899 A * 7/1984 Schmidt et al. ..... 343/841
5,039,994 A * 8/1991 Wash et al. ..... 343/813
5,231,407 A * 7/1993 McGirr et al. ..... 343/700 MS
5,309,164 A * 5/1994 Dienes et al. ..... 343/700 MS
6,218,989 B1 * 4/2001 Schneider et al. ..... 343/700 MS
6,404,393 B1 * 6/2002 Nelson et al. ..... 343/702
6,473,040 B1 * 10/2002 Nakamura ..... 343/700 MS
6,597,325 B2 * 7/2003 Judd et al. ..... 343/853
6,795,021 B2 * 9/2004 Ngai et al. ..... 343/700 MS
2005/0041624 A1 2/2005 Hui et al.

* cited by examiner

*Primary Examiner*—Michael C Wimer

(57) ABSTRACT

This invention describes a method for improving isolation between the main antenna (e.g., a GSM antenna) and at least one further antenna (e.g., a BLUETOOTH/WLAN antenna, a diversity antenna, etc.) in an electronic communication device by a floating parasitic element placed between these two antennas for providing an isolation from electro-magnetically coupled currents between these two antennas in a ground plane, wherein the antennas are connected to the ground plane and the parasitic element is floating and electrically isolated from the ground plane. The advantages of the present invention include but are not limited to a more compact placement of antennas and a reduced cost and better reliability compared to an approach involving grounded parasitic elements.

20 Claims, 3 Drawing Sheets

ISOLATION BETWEEN ANTENNAS USING FLOATING PARASITIC ELEMENTS

CROSS-REFERENCE TO RELATED APPLICATION

This application claims priority from U.S. Provisional Patent Application Ser. No. 60/603,452 filed Aug. 20, 2004.

TECHNICAL FIELD

This invention generally relates to antennas and more specifically to improving isolation between antennas in handsets or wireless communication devices.

BACKGROUND ART

Handsets and other wireless communication devices are undergoing miniaturization. As a result, there is a continuing interest in small antennas that can be internally mounted to the handsets.

In addition, it is desirable for radiophones to be able to operate within multiple frequency bands in order to utilize more than one communication system. For example, the frequency bands allocated in North America are from 824 to 894 MHz for Advanced Mobile Phone Service (AMPS, or Cell band) and from 1850 to 1990 MHz for Personal Communication Services (PCS). GSM (Global System for Mobile communications) is a digital mobile telephone system operating between 880 MHz and 960 MHz. DCS (Digital Communications System) is a digital mobile telephone system operating between 1710 MHz and 1880 MHz. WCDMA (wideband code division multiple access) systems are now deployed over the world (operating frequencies for the WCDMA systems are 1920-2170 MHz for Europe/Asia and 1850-1990 MHz for the USA). To enable mobile handsets to work over service areas with different frequency bands, dual band, triple band, and quad band antennas are needed.

For the 3G systems such as WCDMA and CDMA2000, there are optional requirements specifically for diversity antennas operating at the same frequency band in hand held devices (e.g., in mobile phones, handsets, etc.). Isolation levels between the main antenna and the diversity antenna affect the overall performance of diversity antenna systems in terms of correlation coefficient and radiation efficiency. Therefore, isolation among antennas with different bands as well as in the same band is important for multi-radio terminals.

In ongoing applicant project, due to metallic front and back covers, the BLUETOOTH/WLAN antenna (with operating frequencies 2400-2484 MHz) has been forced to be placed close to the main GSM antenna. Consequently, the isolation between the main and the BLUETOOTH/WLAN antenna is around 12 dB, being 3 dB less than the specification of 15 dB. A Firewall solution with one end grounded can be applied to improve the isolation (e.g., see U.S. patent application Ser. No. 10/453,798, Publication No. 20050041624 A1: "Systems and Methods that Employ a Dualband IFA-Loop CDMA Antenna and a GPS Antenna with a Device for Mobile Communication", by P. Hui, J. V. Wonterghem and S. Eggleston). However, due to compactness of the phone, it is not feasible to introduce additional ground contact pin from the antenna carrier to the PWB (print wiring board) for this project.

Prior art solutions, including placing the BLUETOOTH/WLAN antenna away enough from the main antenna, or using grounded parasitic elements, are difficult to apply because of miniaturization requirements, therefore, an alternative solution is desired.

DISCLOSURE OF THE INVENTION

The object of the present invention is to provide a method for improving isolation between an antenna (e.g., a main antenna such as GSM antenna) and at least one further antenna (e.g., a BLUETOOTH/WLAN antenna) in an electronic communication device using a floating parasitic element placed physically between these two antennas for providing an isolation from electro-magnetically coupled currents between these two antennas in a ground plane.

According to a first aspect of the invention, an electronic communication device comprises: an antenna; at least one further antenna; and at least one parasitic element placed between the antenna and the at least one further antenna for isolating from electro-magnetically coupled currents between the antenna and the at least one further antenna in a ground plane, wherein the antenna and the at least one further antenna are connected to the ground plane and the at least one parasitic element is floating and electrically isolated from the ground plane.

According further to the first aspect of the invention, the electronic communication device may be a portable communication device, a mobile electronic device, a mobile phone, or a handset.

Further according to the first aspect of the invention, the antenna and the at least one further antenna may have different operating frequency ranges.

Still further according to the first aspect of the invention, the antenna may be a main global system for mobile communication (GSM) antenna.

According further to the first aspect of the invention, the at least one further antenna may be a BLUETOOTH/WLAN antenna.

According still further to the first aspect of the invention, the electronic communication device may contain an additional antenna and at least one further parasitic element placed between the additional antenna and the antenna or the at least one further antenna for providing the isolating from electro-magnetically coupled currents in the ground plane between the additional antenna and the antenna or the at least one further antenna.

According further still to the first aspect of the invention, the antenna and the at least one further antenna may have different operating frequencies or the antenna and the at least one further antenna may operate at the same frequency.

According to a second aspect of the invention, a method for isolating from electro-magnetically coupled currents in a ground plane between an antenna and at least one further antenna in an electronic communication device, comprises the step of: placing at least one parasitic element between the antenna and the at least one further antenna for isolating from the electro-magnetically coupled currents, wherein the antenna and the at least one further antenna are connected to the ground plane and the at least one parasitic element is floating and electrically isolated from the ground plane.

According further to the second aspect of the invention, the electronic communication device may be a portable communication device, a mobile electronic device, a mobile phone, or a handset.

Further according to the second aspect of the invention, the antenna and the at least one further antenna may have different operating frequency ranges.

Still further according to the second aspect of the invention, the antenna may be a main global system for mobile communication (GSM) antenna.

According still further to the second aspect of the invention, the at least one further antenna may be a BLUETOOTH/WLAN antenna.

According further still to the second aspect of the invention, the electronic communication device may contain an additional antenna and at least one further parasitic element placed between the additional antenna and the antenna or the at least one further antenna for providing the isolating from electro-magnetically coupled currents in the ground plane between the additional antenna and the antenna or the at least one further antenna.

According yet further still to the second aspect of the invention, the antenna and the at least one further antenna may have different operating frequencies or the antenna and the at least one further antenna may operate at the same frequency.

Advantages of the invention include (but are not limited to):

1. Allowing closer placement of the BLUETOOTH/WLAN antenna to the main antenna (i.e. a more compact placement of antennas), reducing phone size and negative user hand effects.
2. Better isolation between the main and BLUETOOTH/WLAN antennas.
3. Additional design parameter to control radiation patterns and the isolation.
4. Unlike grounded parasitic elements, no physical contact to the PWB is needed, therefore the method is cheaper and more reliable.
5. The method can be also used for improving an isolation level between diversity antennas, thus enhancing their overall performance.

BRIEF DESCRIPTION OF THE DRAWINGS

For a better understanding of the nature and objects of the present invention, reference is made to the following detailed description taken in conjunction with the following drawings, in which.

BEST MODE FOR CARRYING OUT THE INVENTION

The present invention provides a new method for improving isolation between an antenna (e.g., a main antenna) and at least one further antenna (e.g., a BLUETOOTH/WLAN antenna, a diversity antenna, etc.) in an electronic communication device by a parasitic element placed physically between these two antennas for providing an isolation from electro-magnetically coupled currents between these two antennas in a ground plane, wherein the antennas are connected to the ground plane and said parasitic element is floating and electrically isolated from the ground plane.

According to the present invention, the electronic communication device can be (but is not limited to) a portable communication device, a mobile electronic device, a mobile phone, or a handset. Moreover, the antenna and the further antenna typically can have different operating frequency ranges as well as the same operating frequency (e.g., for the diversity antennas). Furthermore, in the mobile phone the main antenna can be, e.g., a global system for mobile communication (GSM) antenna. In addition, if the electronic communication device contains additional antennas, more additional parasitic elements can be placed between the additional antennas, main and further antennas for providing said isolating from electro-magnetically coupled currents between these antennas.

Figure 1:
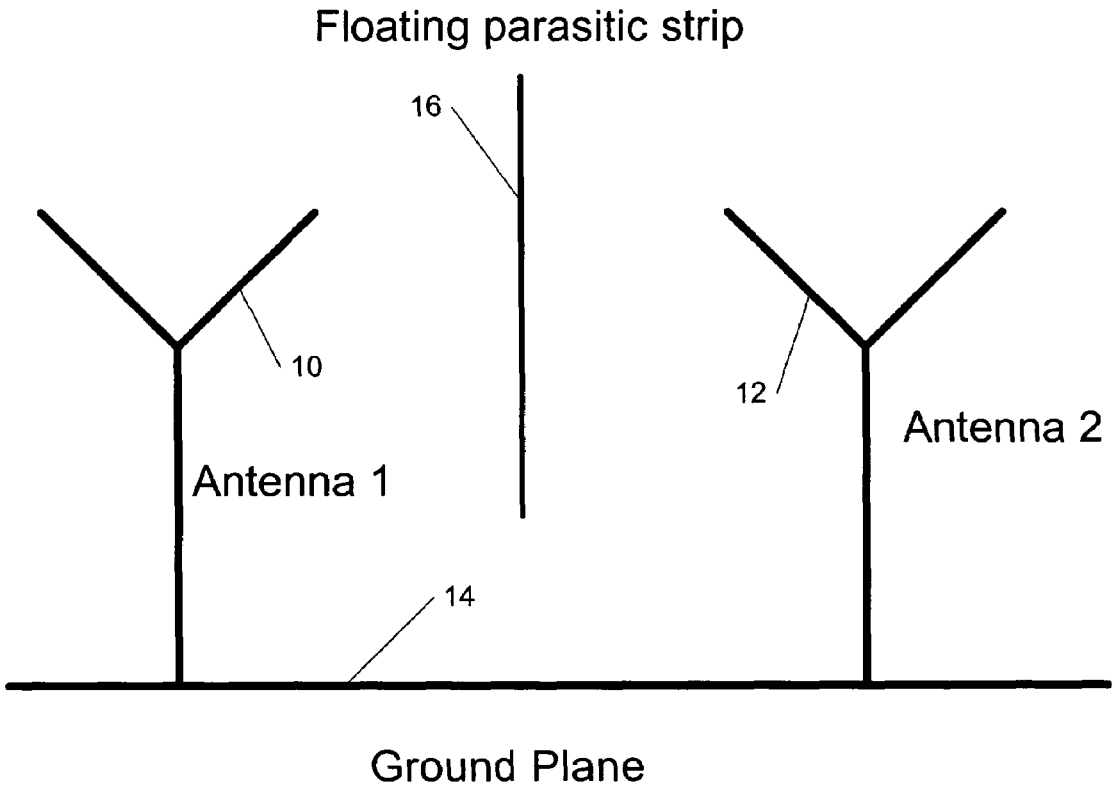
FIG. 1 is a schematic representation demonstrating a concept for improving isolation between antennas using floating parasitic elements, according to the present invention.

FIG. 1 shows one example among others demonstrating a concept for improving isolation between antennas using floating parasitic elements, according to the present invention. As seen in FIG. 1 two antennas 10 and 12 are grounded to a ground plane 14. A floating parasitic element (strip) 16 is placed between the two antennas 10 and 12. The floating parasitic element 16 is floating and electrically isolated from the ground plane 14. According to the present invention, the parasitic element 16 provides an isolation from electro-magnetically coupled currents between these two antennas 10 and 12 in a ground plane 14.

Figure 2:
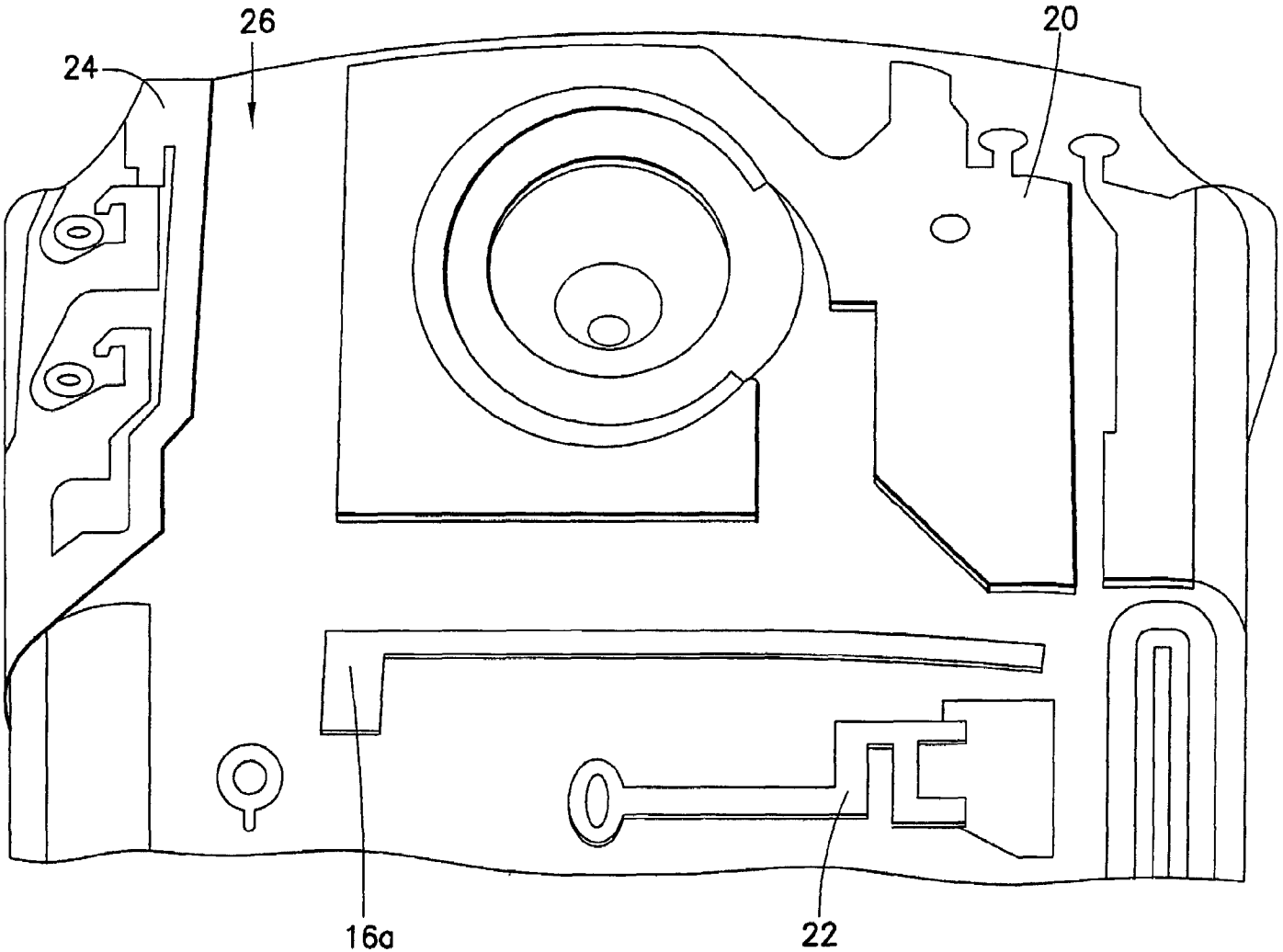
FIG. 2 is a picture of a prototype device demonstrating one possible implementation of isolation between main (triple band GSM antenna) and BLUETOOTH/WLAN antenna, according to the present invention.

FIG. 2 is one example among many others of a prototype device demonstrating one possible implementation of isolation between the main antenna (a triple band GSM) 20 and the BLUETOOTH/WLAN antenna 22 using a floating parasitic element (strip) **16*a*, according to the present invention. In addition to isolating between antennas 22 and 22, the floating parasitic strip 16*a* can also provide (as seen in FIG. 2) an isolation between the BLUETOOTH/WLAN antenna 22 and an additional WCDMA antenna 24. In principle a further floating parasitic element can be introduced in the area between the antennas 20 and 24 as indicated by an arrow 26**.

The general guideline for selection of the length of the floating parasitic strip is a half wavelength at the frequency of interest. However, due to a close proximity to other antennas, the optimized length of the parasitic element is better determined experimentally, based, e.g., on antenna gain performance and/or a required isolation level.

Figure 3:
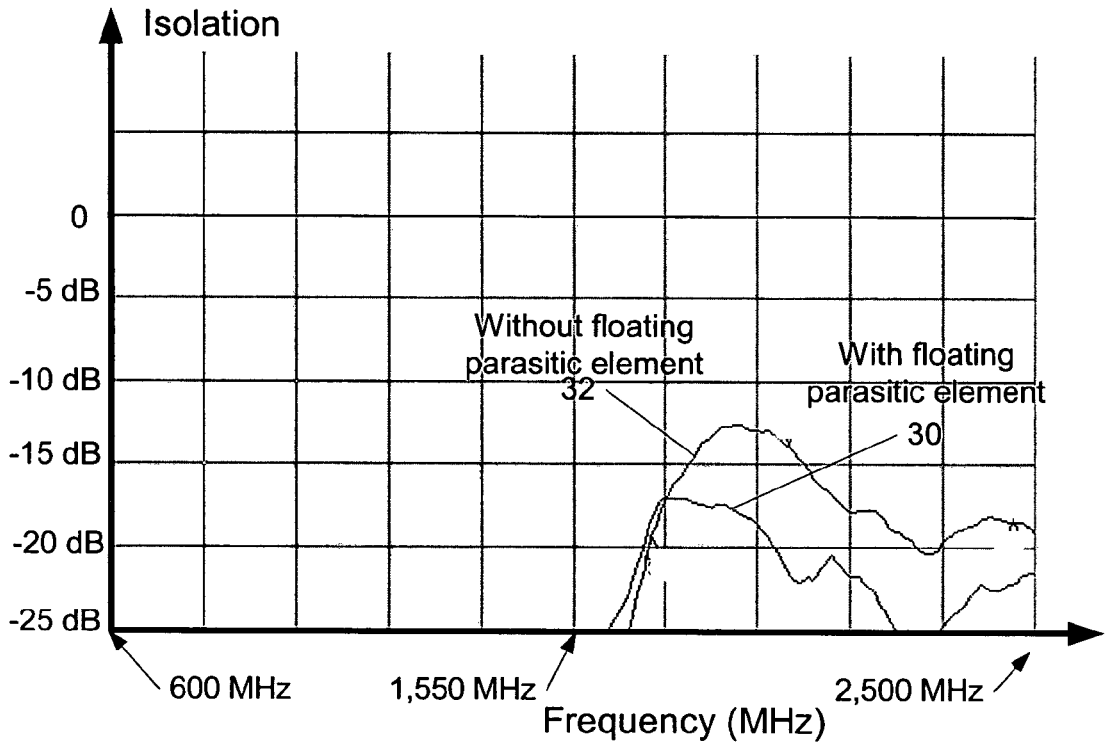
FIG. 3 is a graph demonstrating isolation between the main and BLUETOOTH/WLAN antennas in a frequency domain, according to the present invention.

FIG. 3 shows an example among many others of a graph demonstrating isolation between the main antenna 20 and the BLUETOOTH/WLAN antenna 22 in a frequency domain, according to the present invention. Curve 32 is an isolation curve (isolation in dB as a function of frequency) for the arrangement (e.g., as shown in FIG. 2) with the floating parasitic element **16*a* and an isolation curve 30 is for the case without the floating parasitic element 16*a*. As seen from FIG. 3, the presence of the floating parasitic element 16*a*** between the main and BLUETOOTH/WLAN antennas improved the isolation by 8 dB compared to the case without the floating parasitic element in the frequency range of interest, i.e., in the 1900 MHz band.

The present invention can be implemented in a variety of ways. The idea of using the floating parasitic elements should be applicable to a general type of antennas, especially for some difficult cases described below. For example, isolation is usually worse for two antennas operating at two close frequencies such as between PCS and BLUETOOTH/WLAN bands which can be effectively corrected by applying the present invention. The situation is even worse for two antennas operating at the same frequency, e.g., in case of diversity antennas. Moreover, it is noted that the self-jamming becomes more problematic for multi-mode radios. The requirement for better isolation among antennas has been a challenging design issue for the above examples and the method of isolation using the floating parasitic elements described by the present invention can be an effective tool for improving isolation between antennas from electro-magnetically coupled currents in the ground plane for the above examples.

It is to be understood that the above-described arrangements are only illustrative of the application of the principles of the present invention. Numerous modifications and alternative arrangements may be devised by those skilled in the art without departing from the scope of the present invention, and the appended claims are intended to cover such modifications and arrangements.

What is claimed is:

1. An apparatus comprising:

an antenna;

at least one further antenna; and at least one parasitic element placed between said antenna and said at least one further antenna and having a length optimized around a half wavelength of an operation frequency of said antenna to isolate from electro-magnetically coupled currents between said antenna and said at least one further antenna in a ground plane, wherein said antenna and said at least one further antenna are connected to said ground plane and said at least one parasitic element is floating and electrically isolated from said ground plane.

2. The apparatus of claim 1, wherein said apparatus is an electronic communication device configured for wireless communications.

3. The apparatus of claim 1, wherein said antenna and said at least one further antenna have different operating frequency ranges.

4. The apparatus of claim 1, wherein said antenna is a main antenna of a global system for mobile communications.

5. The apparatus of claim 1, wherein said at least one further antenna is a BLUETOOTH/wireless local area network antenna.

6. The apparatus of claim 1, wherein said apparatus comprises an additional antenna and at least one further parasitic element placed between said additional antenna and said antenna or said at least one further antenna to provide said isolating from electro-magnetically coupled currents in said ground plane between said additional antenna and said antenna or said at least one further antenna.

7. The apparatus of claim 1, wherein said antenna and said at least one further antenna have different operating frequencies.

8. The apparatus of claim 1, wherein said antenna and said at least one further antenna are configured to operate at the same frequency.

9. The apparatus of claim 1, wherein said at least one parasitic element has the length of said half wavelength at the operation frequency of said antenna.

10. A method, comprising: placing at least one parasitic element between an antenna and at least one further antenna and having a length optimized around a half wavelength of an operation frequency of said antenna to isolate in an electronic communication device from electro-magnetically coupled currents, wherein said antenna and said at least one further antenna are connected to a ground plane and said at least one parasitic element is floating and electrically isolated from said ground plane for said isolating from said electro-magnetically coupled currents in said ground plane between the antenna and the at least one further antenna.

11. The method of claim 10, wherein said electronic communication device is a portable communication device, a mobile electronic device, a mobile phone, or a handset.

12. The method of claim 10, wherein said antenna and said at least one further antenna have different operating frequency ranges.

13. The method of claim 10, wherein said antenna is a main antenna of a global system for mobile communications.

14. The method of claim 10, wherein said at least one further antenna is a BLUETOOTH/wireless local area network antenna.

15. The method of claim 10, wherein said electronic communication device comprises an additional antenna and at least one further parasitic element placed between said additional antenna and said antenna or said at least one further antenna to provide said isolating from electro-magnetically coupled currents in said ground plane between said additional antenna and said antenna or said at least one further antenna.

16. The method of claim 10, wherein said antenna and said at least one further antenna have different operating frequencies.

17. The method of claim 10, wherein said antenna and said at least one further antenna are configured to operate at the same frequency.

18. The method of claim 10, wherein said at least one parasitic element has the length of said half wavelength at the operation frequency of said antenna.

19. An apparatus comprising:

means for receiving;

at least one further means for receiving; and at least one means for isolating, placed between said means for receiving and said at least one further means for receiving and having a length optimized around a half wavelength of an operation frequency of said antenna to isolate from electro-magnetically coupled currents between said means for receiving and said at least one further means for receiving in a ground plane, wherein said means for receiving and said at least one further means for receiving are connected to said ground plane and said at least one means for isolating is floating and electrically isolated from said ground plane.

20. The apparatus of claim 19, wherein said means for receiving is an antenna, said at least one further means for receiving is at least one further antenna, and said at least one means for isolating is at least one parasitic element.

* * * * *